US011413503B2

(12) United States Patent
Kim et al.

(10) Patent No.: US 11,413,503 B2
(45) Date of Patent: Aug. 16, 2022

(54) APPARATUS AIDING BODY BALANCE

(71) Applicants: Yang Guy Moon, Ulsan (KR); Jung Woo Lee, Ulsan (KR)

(72) Inventors: Kwan Myung Kim, Ulsan (KR); Gabbas Malika, Ulsan (KR)

(73) Assignees: Yang Gyu Moon, Ulsan (KR); Jung Woo Lee, Ulsan (KR)

( * ) Notice: Subject to any disclaimer, the term of this patent is extended or adjusted under 35 U.S.C. 154(b) by 0 days.

(21) Appl. No.: 17/053,618

(22) PCT Filed: Oct. 17, 2019

(86) PCT No.: PCT/KR2019/013665

§ 371 (c)(1),
(2) Date: Nov. 6, 2020

(87) PCT Pub. No.: WO2020/080852

PCT Pub. Date: Apr. 23, 2020

(65) Prior Publication Data

US 2021/0245008 A1 Aug. 12, 2021

(30) Foreign Application Priority Data

Oct. 19, 2018 (KR) ..... 10-2018-0125232

(51) Int. Cl.
*A63B 26/00* (2006.01)
*A63B 21/00* (2006.01)

(52) U.S. Cl.
CPC ..... *A63B 26/003* (2013.01); *A63B 21/4034* (2015.10); *A63B 2208/0204* (2013.01); *A63B 2225/09* (2013.01)

(58) Field of Classification Search
CPC ..... A63B 26/003; A63B 21/4034; A63B 2208/0204; A63B 2225/09; A63B 23/08;
(Continued)

(56) References Cited

U.S. PATENT DOCUMENTS 3,297,320 A * 1/1967 Di Benedetto ..... A63B 23/085 482/148
3,401,931 A * 9/1968 McCafferty ..... A63K 3/023 482/19
(Continued)

FOREIGN PATENT DOCUMENTS

CN 2857999 Y 1/2007
CN 205252423 U 5/2016
(Continued)

OTHER PUBLICATIONS

KR10-1556951 translation (derived from: Espacenet) (Year: 2015).*
(Continued)

*Primary Examiner* — Joshua Lee
*Assistant Examiner* — Catrina A Letterman
(74) *Attorney, Agent, or Firm* — Kinney & Lange, P.A.

(57) ABSTRACT

An apparatus aiding body balance comprises: a support portion placed on the ground; a foothold portion having one end rotatably coupled to one end of the support portion; and an inclination adjustment portion having one end rotatably provided on the other end of the foothold portion and the other end supported by the support portion, thus enabling the adjustment of the angle between the foothold portion and the support portion.

4 Claims, 6 Drawing Sheets

(58) Field of Classification Search
CPC ..... A63B 2023/006; A63B 71/0054; A63B 2210/50; A63B 2213/00; A63B 2225/093; A63B 5/08–2005/085; A63B 2022/0033; A63B 2022/0048; A63B 2022/0056; A63B 2022/04; A63B 2022/0097; A63B 26/00–2026/006; A61H 1/0266; A61H 2201/0192; A61H 1/02; A61H 1/0237; A61H 1/027
See application file for complete search history.

(56) References Cited

U.S. PATENT DOCUMENTS

| | | | | | |
|---|---|---|---|---|---|
| 3,746,335 | A * | 7/1973 | Fichter | A63K 3/023 | 482/19 |
| 4,111,416 | A * | 9/1978 | Jinotti | A63B 21/023 | 482/128 |
| 4,422,635 | A * | 12/1983 | Herod | A63B 23/03533 | 248/464 |
| 5,087,036 | A * | 2/1992 | Cooper | A63B 23/085 | 482/79 |
| 6,244,992 | B1 * | 6/2001 | James | A61H 1/0237 | 482/19 |
| 8,444,532 | B1 * | 5/2013 | Barcena | A63B 21/4035 | 482/51 |
| 9,364,382 | B1 * | 6/2016 | Cooper | A61H 1/0266 | |
| 10,772,783 | B2 * | 9/2020 | Dunca | A63B 21/05 | |
| 2005/0164844 | A1 * | 7/2005 | Johnson | A63B 23/08 | 482/79 |
| 2014/0171213 | A1 * | 6/2014 | Newman | A63B 69/3673 | 473/270 |
| 2019/0088160 | A1 * | 3/2019 | Liu | A63B 23/0244 | |

FOREIGN PATENT DOCUMENTS

| | | | | |
|---|---|---|---|---|
| CN | 207935657 | U | 10/2018 | |
| JP | 2001314480 | A | 11/2001 | |
| JP | 2003180720 | A | 7/2003 | |
| JP | 2003245377 | A | 9/2003 | |
| JP | 2012005524 | A | 1/2012 | |
| KR | 10-2004-008329 | * | 10/2004 | A63B 23/08 |
| KR | 1020040088329 | A | 10/2004 | |
| KR | 20100012275 | A | 2/2010 | |
| KR | 1020100012275 | A | 2/2010 | |
| KR | 20120008928 | A | 2/2012 | |
| KR | 200463120 | B1 | 10/2012 | |
| KR | 10-1556951 | * | 10/2015 | A63B 23/0405 |
| KR | 101556951 | B1 | 10/2015 | |
| KR | 200482054 | Y1 | 12/2016 | |
| KR | 101975220 | B1 | 5/2019 | |

OTHER PUBLICATIONS

KR10-2004-0088329 translation (derived from: Espacenet) (Year: 2004).*
Chinese Office Action dated Apr. 27, 2021, received for corresponding Chinese Application No. 201980028422.0, 7 pages.
English translation of International Search Report dated Feb. 5, 2020, for corresponding PCT Application No. PCT/KR2019/013665.
Extended European Search Report dated Nov. 9, 2021, for corresponding European Application No. 19873948.
Japanese Office Action dated Oct. 19, 2021, for corresponding Japanese Application No. 2021-506606.

* cited by examiner

APPARATUS AIDING BODY BALANCE

CROSS-REFERENCE TO RELATED APPLICATION(S)

This application is the national phase of PCT Application No. PCT/KR2019/013665 filed on Oct. 17, 2019, which in turn claims priority to Korean Application No. 10-2018-0125232 filed on Oct. 19, 2018, the disclosures of which are incorporated herein by reference.

BACKGROUND

Technical Field

The present disclosure relates to a body balance training apparatus, and more particularly, to a body balance training apparatus that improves body coordination capabilities such as muscle strength, flexibility, and posture correction via body balance exercises, thereby to improve health.

Description of Related Art

In general, exercises to improve health include aerobic exercise for oxidation of body fat, muscle training to strengthen muscle strength, or body balance exercise to improve blood circulation and remove body imbalance. Among the above-mentioned exercises, the body balance exercise may stably maintain the balance of the body to improve a sense of balance to have effects such as muscle strength, flexibility, posture correction, etc. For the body balance exercise, a user stands on a balance beam and spreads both arms and balances the body with one leg, or sits on a soft device such as a gym ball and balances the body thereon, or stands on an inclined foot stand and maintain a target posture.

A conventional body balance training apparatus is disclosed in Korean registered utility model No. 20-0463120.

However, the conventional body balance training apparatus is configured to have an inclined face formed using an elastic refractive member having elastic force to train the sense of balance of the body. However, there is a risk of falls during exercise due to an unfixed inclination angle. Further, it is difficult to selectively change the angle of inclination to various angles, thereby to reduce use efficiency. Further, when the apparatus is not in use, the apparatus occupies an space indoors, thereby limiting a space for storage in a small house such as a studio.

SUMMARY

The present disclosure is provided to solve the above-described problems, and has a purpose to provide a body balance training apparatus with high use efficiency and easy storage.

A body balance training apparatus to achieve the purpose includes a support placed on a ground; a foot stand having one end pivotally coupled to one end of the support; and an inclination adjuster having one end pivotably coupled to an opposite end of the foot stand, and an opposite end supported on the support, such that the inclination adjuster adjusts an angle between the foot stand and the support.

In this connection, the support includes: a support frame having one end pivotally coupled to a middle region of one end of the foot stand; and a pair of support blocks pivotally coupled to both opposing sides of an opposite end of the support frame, respectively, wherein each support block has a plurality of catching grooves defined therein and spaced apart from each other along a longitudinal direction of each support block.

Further, the inclination adjuster includes a pair of cylindrical stopper protrusions formed at both opposing sides of the opposite end thereof, wherein each of the catching grooves has a semi-cylindrical shape, so that each of the pair of the stopper protrusions is received in a selected catching groove of each support block.

Further, the foot stand includes: a hinge rotatably coupled to one end of the support; a foot stand frame coupled to the hinge and having a curved shape; and a foot stopper protruding from a top face of the foot stand frame and at a location thereof adjacent to the hinge and extending along a width direction of the foot stand frame.

Moreover, the foot stand frame further includes slipping-prevention means embodied as a plurality of projections formed on the top face of the foot stand frame.

According to the body balance training apparatus according to the present disclosure, the angle between the foot stand and the support may be selectively adjusted using the inclination adjuster, so that intensity of the body balance exercise may be adjusted based on the inclination of the foot stand, thereby improving the use efficiency.

Further, the stopper is formed on a lower position of the foot stand frame, and the slipping-prevention means is provided thereon, so that the foot may be stably supported thereon without slipping on the foot stand having the inclination.

In addition, the foot stand, the support, and the inclination adjuster are connected to each other to be pivotable to each other, so that the body balance training apparatus may be folded into a flat manner or folded into a smaller volume. Further, a plurality of body balance training apparatuses may be combined with each other. Thus, when not using the body balance training apparatus, the apparatus may be easily stored and allow more efficient space utilization.

DETAILED DESCRIPTION

Figure 1:
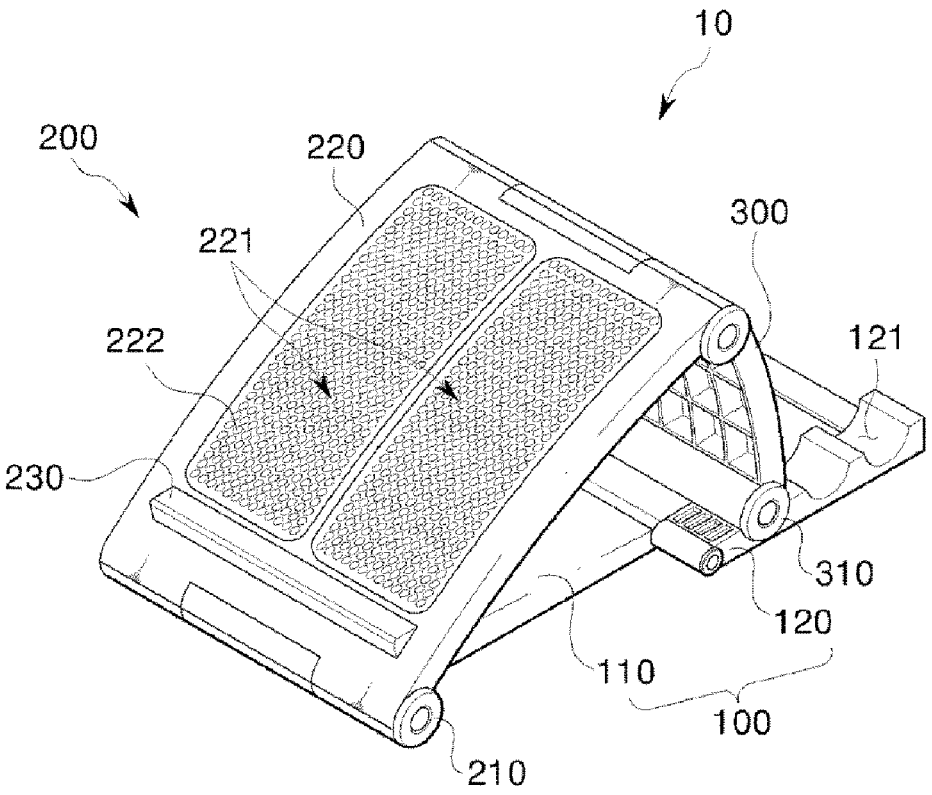
FIG. 1 is a perspective view of a body balance training apparatus according to an embodiment according to the present disclosure.
Figure 2:
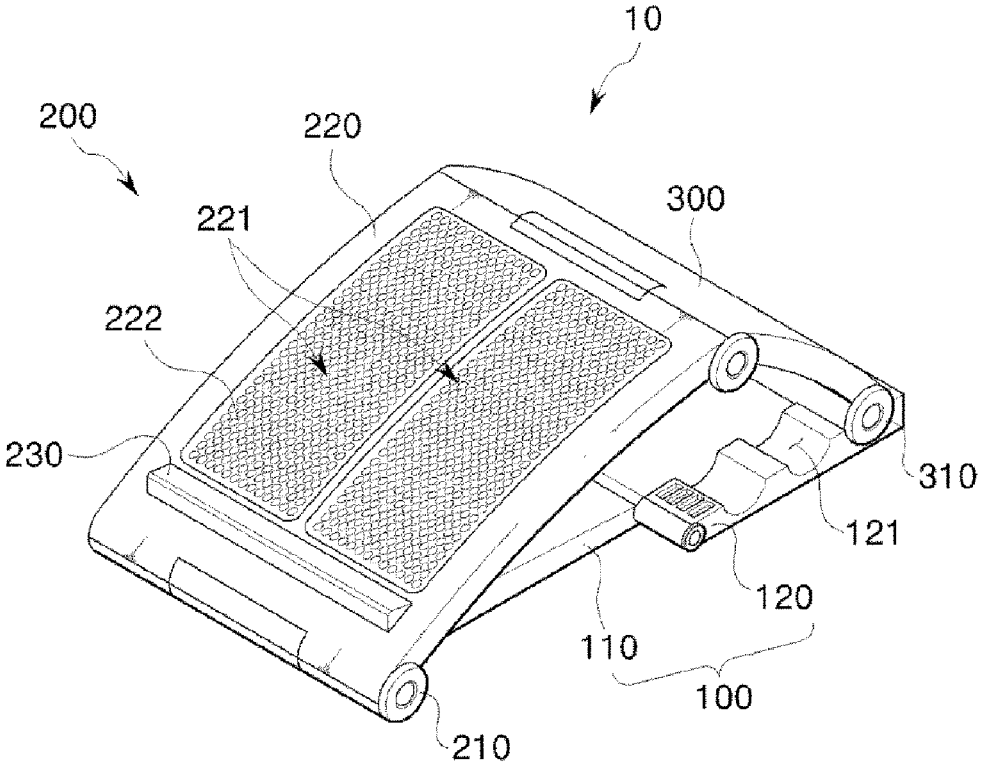
FIG. 2 is a perspective view showing a state in which an angle between a foot stand and a support of the body balance training apparatus in FIG. 1 is changed.
Figure 3:
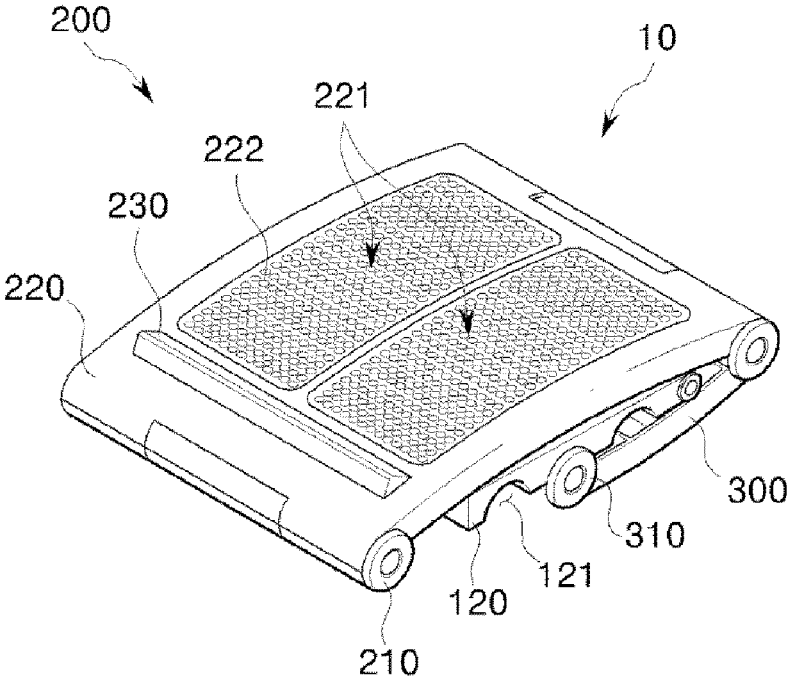
FIG. 3 is a perspective view showing a folded state of the body balance training apparatus of FIG. 1.

Hereinafter, preferred embodiments of the present disclosure will be described in detail with reference to the accompanying drawings. Prior to this description, it should be noted that terms or words used in the specification and claims should not be construed as being limited to conventional or dictionary meaning, but should be interpreted as meaning and concept consistent with a technical idea of the present disclosure, based on the principle that the present inventors may appropriately define the concept of the terms in order to describe their own invention in the best way.

Therefore, embodiments described in the present specification and configurations shown in the drawings are only the most preferred embodiments of the present disclosure, and do not represent all the technical ideas of the present disclosure. Thus, it should be understood that when filing the present application, there may be equivalent variations that may replace the embodiments.

Hereinafter, an embodiment according to the present disclosure will be described in detail with reference to the accompanying drawings.

Referring to FIG. 1 to FIG. 6, a body balance training apparatus 10 according to an embodiment according to the present disclosure includes a support 100, a foot stand 200, and an inclination adjuster 300.

The support 100 is placed on a ground. The support 100 may include a support frame 110 and a pair of support blocks 120.

The support frame 110 is embodied as a rectangular parallelepiped plate, and is placed on the ground. The support frame 110 is pivotably coupled, at one end thereof, to one end of the foot stand 200 to be described later. In addition, a width of the support frame 110 may be smaller than a width of the foot stand 200, and may be pivotably coupled to a middle region of one end of the foot stand 200.

The pair of support blocks 120 are pivotably and respectively coupled to both opposing ends of an opposite side of the support frame 110 to one side at which the support frame 110 is pivotably coupled to the food stand 200. That is, the pair of support blocks 120 may be pivotably coupled to both ends in a width direction of the opposite side of the support frame 110, respectively. Further, it is preferable that a sum of widths of the pair of support blocks 120 and the width of the support frame 100 may be equal to the width of the foot stand 200. The pair of support blocks 120 are configured for supporting the inclination adjuster 300 to be described later. To this end, a plurality of catching grooves 121 spaced apart from each other in a longitudinal direction of each support block are defined in each support block. The catching groove 121 is preferably formed in a semi-cylindrical shape.

A user may stand on a top face of the foot stand 200. One end of the foot stand 200 may be pivotably coupled to one end of the support 100. The foot stand 200 may include a hinge 210, a foot stand frame 220, and a stopper 230.

The hinge 210 is rotatably coupled to one end of the support 100. That is, the support 100 may be pivotally coupled to the hinge 210. In addition, a length of the hinge 210 may be larger than the width of the support 100. It is preferable that the support 100 is pivotably coupled to a middle region of the hinge 210.

The foot stand frame 220 is embodied as a plate supporting the foot, and is coupled to the hinge 210. Therefore, the foot stand frame 220 is pivotably coupled to the support 100 via the hinge 210. The foot stand frame 220 may have a convex curved top face. The foot stand frame 220 may pivot to be inclined upwardly from one side to the opposite side. Therefore, the user may perform the body balance exercise while standing on the inclined and convex curved top face of the foot stand frame 220. The foot stand frame 220 may further include slipping-prevention means 221.

The slipping-prevention means 221 may include a plurality of protrusions 222 arranged on the top face of the foot stand frame 220. That is, the user may perform the body balance exercise while stepping on the slipping-prevention means 221. The slipping-prevention means 221 may be formed along a longitudinal direction of the foot stand frame 220 and on the top face of the foot stand frame 220. The slipping-prevention means 221 may prevents the foot from slipping when the user's foot is placed on the foot stand frame 220, thereby to maintain the feet of the user to be stable. Further, the plurality of protrusions 222 may allow acupressure effect to the feet.

The foot stopper 230 stop downward movement of the foot, and protrudes from a top face of a lower portion of the foot stand frame 220. In addition, the foot stopper 230 may be embodied as an elongate triangular pillar and may extend along a width direction of the foot stand frame 220. Therefore, the foot stopper 230 may prevent the foot from slipping out of the foot stand frame 220 when performing the body balance exercise while standing on the top face of the foot stand frame 220, thereby stably training the body balance.

The inclination adjuster 300 is configured for adjusting an angle between the foot stand 200 and the support 100. To this end, one end of the inclination adjuster 200 is pivotably coupled to an opposite end of the foot stand 200. The inclination adjuster 300 has an opposite end supported on the support 100 so that the angle between the foot stand 200 and the support 100 may be adjusted. That is, the inclination of the foot stand 200 may be selectively changed based on a position along each support block 120 at which the opposite end of the inclination adjuster 300 is supported on the support 100. The inclination adjuster 300 may include a pair of stopper protrusions 310.

The pair of stopper protrusions 310 are respectively disposed at both opposing sides in a width direction of the opposite end of the inclination adjuster 300 and are formed in a cylindrical shape. The pair of stopper protrusions 310 may respectively be caught into the catching grooves 121 defined in the pair of support blocks 120. That is, sizes and positions of the pair of stopper protrusions 310 may correspond to sizes and positions of the catching grooves 121. As the stopper protrusions 310 are respectively caught into the catching grooves 121, the opposite end of the inclination adjuster 300 may be supported on the support 100. Thus, as the foot stand 200 goes from one side to the opposite side, the foot stand 200 may be inclined upwards. The angle between the support 100 and the foot stand 200 may be adjusted based on the caught position of the stopper protrusions 310. More specifically, the plurality of catching grooves 121 are arranged and spaced apart from each other along the longitudinal direction of each of the support blocks 120. The stopper protrusions 310 are received in selected grooves of the plurality of catching grooves 121, so that inclination of the foot stand 200 may be selectively adjusted. Therefore, the inclination adjuster 300 may be used to selectively adjust the angle between the foot stand 200 and the support 100. The intensity of the body balance exercise may be adjusted based on the inclination of the foot stand 200, thereby increasing the use efficiency.

Figure 4A:
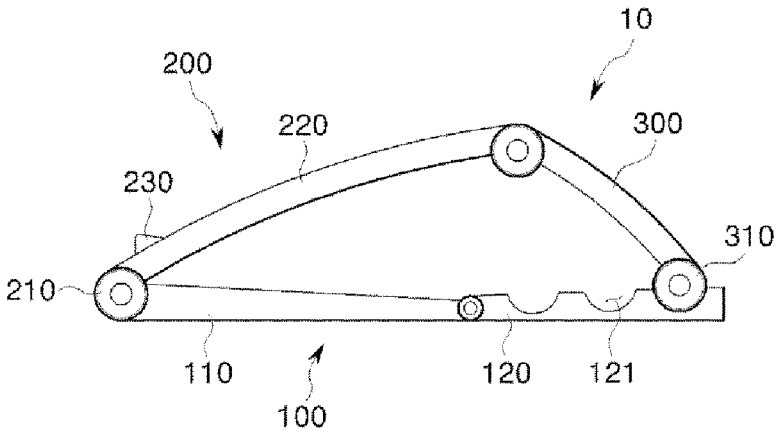
FIGS. 4A-4C is side elevation views sequentially showing a process of folding the body balance training apparatus of FIG. 1.
Figure 4B:
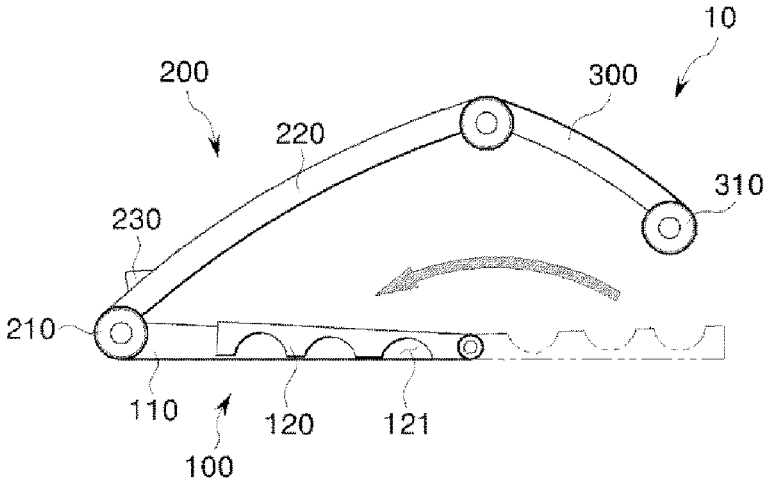
Figure 4C:
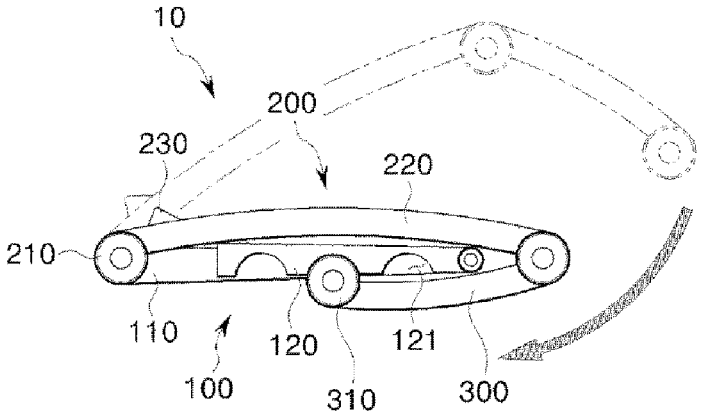

Further, the body balance training apparatus 10 may be folded into a flat shape or folded into a smaller size for easy storage as the support 100, the foot stand 200 and the inclination adjuster 300 are configured to be pivotable to each other. With reference to FIG. 4, a process of folding the body balance training apparatus 10 into a smaller size will be described step by step. (a) FIG. 4 shows that the foot stand 200 is inclined upwards from one side to the opposite side. Thus, the user may perform the body balance exercise while stepping on the top face of the foot stand 200 as inclined upwards.

First, referring to (b) in FIG. 4, the user may pivot the pair of support blocks 120 toward the support frame 110 and may overlap the same with the support frame 110. In this connection, when the pair of support blocks 120 overlap the support frame 110, an opening of each of the plurality of catching grooves 121 may face downwards.

Figure 5:
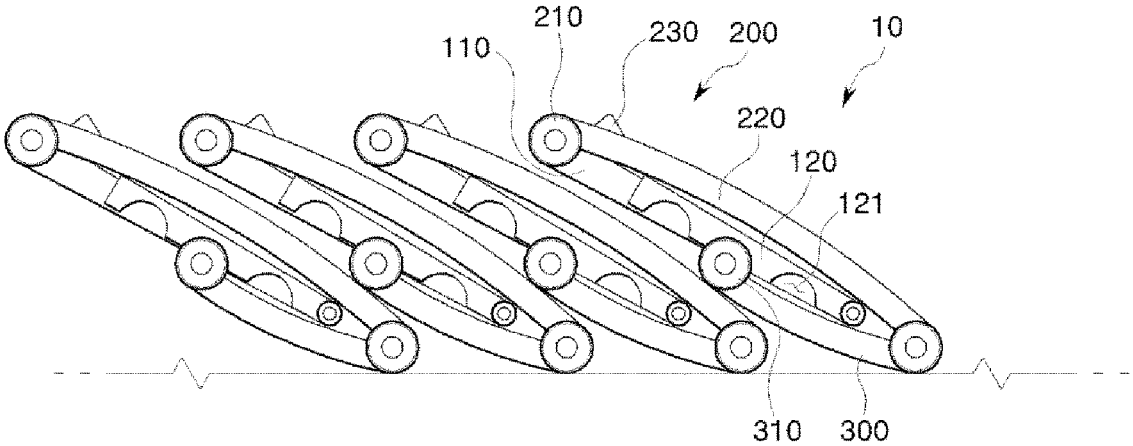
FIG. 5 and FIG. 6 are side elevation views showing a state in which a plurality of body balance training apparatuses in FIG. 1 are folded and stored.

Next, as shown in (c) in FIG. 4, the user may pivot the inclination adjuster 300 in a clockwise manner such that the adjuster 300 is positioned beneath the support 100 in an overlapping manner. As the inclination adjuster 300 is disposed beneath the support 100, the pair of stopper protrusions 310 may be engaged with and received in the pair of catching grooves 121, respectively. That is, when pivoting the inclination adjuster 300 such that the stopper protrusions 310 are caught into the catching grooves 121, the body balance training apparatus 10 may be folded into a smaller size and may be stably maintained in the folded state. Further, since the foot stand 200 has a curved shape, the support 100 may be easily positioned below the foot stand 200. Therefore, as shown in FIG. 5, the body balance training apparatus 10 is foldable into a flat shape or a smaller volume. Thus, it is easy to store the plurality of the body balance training apparatus 10.

Figure 6:
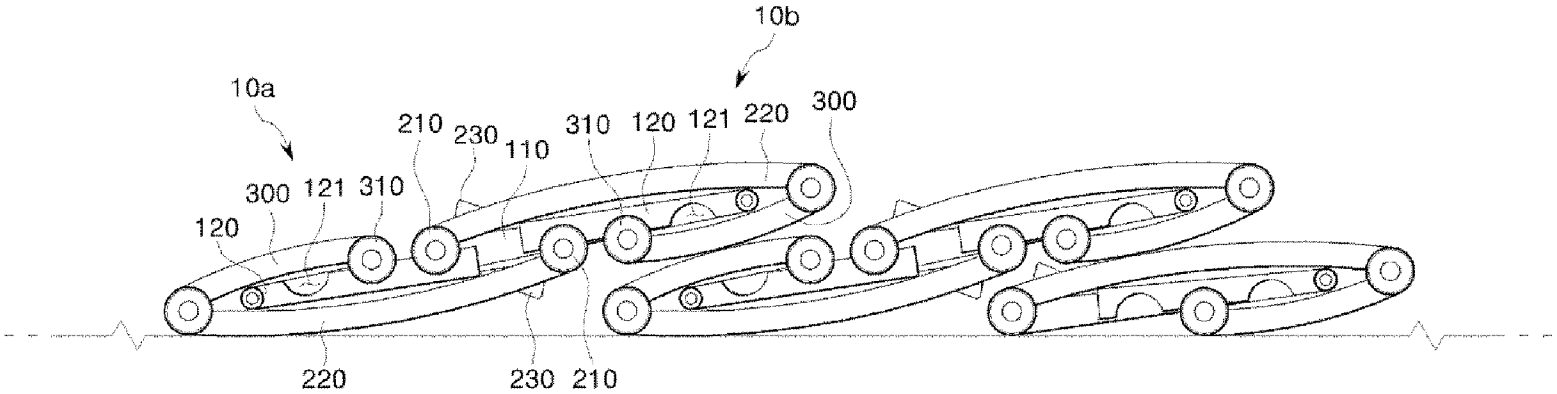

In one example, the hinge 210 has a diameter corresponding to that of the catching groove 121. Therefore, as shown in FIG. 6, the user may engage the hinge 210 of one body balance training apparatus 10*b* into the catching groove 121 of an adjacent body balance training apparatus 10*a*, thereby to couple the plurality of body balance training apparatus 10*a* in the folded state to each other. That is, the plurality of body balance training apparatuses 10*a* and 10*b* in the folded state may be combined with each other and may be maintained in the combined state for easy storage thereof.

According to the body balance training apparatus according to the present disclosure, the angle between the foot stand and the support may be selectively adjusted using the inclination adjuster, so that intensity of the body balance exercise may be adjusted based on the inclination of the foot stand, thereby improving the use efficiency.

Further, the stopper is formed on a lower position of the foot stand frame, and the slipping-prevention means is provided thereon, so that the foot may be stably supported thereon without slipping on the foot stand having the inclination.

In addition, the foot stand, the support, and the inclination adjuster are connected to each other to be pivotable to each other, so that the body balance training apparatus may be folded into a flat manner or folded into a smaller volume. Further, a plurality of body balance training apparatuses may be combined with each other. Thus, when not using the body balance training apparatus, the apparatus may be easily stored and allow more efficient space utilization.

The present disclosure has been described with reference to the embodiment shown in the drawings, but this is only exemplary. Those of ordinary skill in the art will understand that various modifications and equivalent other embodiments are realized therefrom. Therefore, the scope of true technical protection of the present disclosure should be determined by the technical idea of the attached claims.

What is claimed is:

1. A body balance training apparatus comprising:

a support placed on a ground;

a foot stand having a first end pivotally coupled to a first end of the support; and an inclination adjuster having a first end pivotably coupled to a second end of the foot stand, and a second end supported on the support, such that the inclination adjuster adjusts an angle between the foot stand and the support;

wherein the support includes:

a support frame having a first end pivotally coupled to a middle region of the first end of the foot stand; and a pair of support blocks pivotally coupled to both opposing sides of a second end of the support frame, respectively, wherein each support block has a plurality of catching grooves defined therein and spaced apart from each other along a longitudinal direction of each support block.

2. The body balance training apparatus of claim 1, wherein the inclination adjuster includes a pair of cylindrical stopper protrusions formed at both opposing sides of the second end thereof, wherein each of the catching grooves has a semi-cylindrical shape, so that each of the pair of the stopper protrusions is received in a selected catching groove of each support block.

3. The body balance training apparatus of claim 1, wherein the foot stand includes:

a hinge rotatably coupled to the first end of the support;

a foot stand frame coupled to the hinge and having a curved shape; and a foot stopper protruding from a top face of the foot stand frame and at a location thereof adjacent to the hinge and extending along a width direction of the foot stand frame.

4. The body balance training apparatus of claim 3, wherein the foot stand frame further includes slipping-prevention means embodied as a plurality of projections formed on the top face of the foot stand frame.

* * * * *